United States Patent [19]

Aoki

[11] 4,077,364

[45] Mar. 7, 1978

[54] ELECTRONIC CONTROL FUEL SUPPLY SYSTEM

[75] Inventor: Keiji Aoki, Susono, Japan

[73] Assignee: Toyota Jidosha Kogyo Kabushiki Kaisha, Aichi, Japan

[21] Appl. No.: 721,229

[22] Filed: Sep. 8, 1976

[30] Foreign Application Priority Data

Apr. 30, 1976 Japan ..... 51-53280[U]

[51] Int. Cl.[2] ..... F02B 3/00; F02B 33/00

[52] U.S. Cl. ..... 123/32 EH; 123/32 EE; 60/285

[58] Field of Search ..... 123/32 EE, 32 EH, 119 EC; 60/276, 285

[56] References Cited

U.S. PATENT DOCUMENTS

| | | | |
|---|---|---|---|
| 3,782,347 | 1/1974 | Schmidt et al. | 60/276 |
| 3,903,853 | 9/1975 | Kizler et al. | 123/32 EE |
| 3,910,240 | 10/1975 | Omori et al. | 123/32 EE |
| 3,990,411 | 11/1976 | Toelle | 123/32 EE |
| 4,010,717 | 3/1977 | Taplin | 123/32 EH |

*Primary Examiner*—Ronald B. Cox
*Attorney, Agent, or Firm*—Stevens, Davis, Miller & Mosher

[57] ABSTRACT

An electronic control fuel supply system for use in an internal combustion engine. The system includes a λ sensor adapted to digitally vary an output signal in response to the air-fuel ratio of an air-fuel mixture being supplied to the engine, and an integrating circuit. The input of the integrating circuit is connected to the output of the λ sensor and has a time constant whereby the open duration of a fuel injection valve provided in the engine intake system is controlled by the output voltage of the integrating circuit. In this fuel supply system, the time constant of the integrating circuit is changed from a first value to a smaller second value after the start of acceleration of the internal combustion engine and during the time that the air-fuel ratio of the mixture is larger than a predetermined value. The integrating circuit is connected to a fuel-amount control circuit which in turn is connected to the fuel injection valve which opens into the intake system of the engine.

8 Claims, 3 Drawing Figures

ELECTRONIC CONTROL FUEL SUPPLY SYSTEM

BACKGROUND OF THE INVENTION

1. Field of the Invention

This invention relates to an electronic control fuel supply system for use in controlling the air-fuel ratio of the mixture of air and fuel being supplied to an internal combustion engine.

2. Description of the Prior Art

In a known electronic control fuel supply system, a λ sensor is utilized to detect the actual air-fuel ratio of the mixture being supplied to an engine. Report No. 730566 of The Society of Automotive Engineers discloses a detailed arrangement of a λ sensor positioned in the exhaust system of an engine, the λ sensor being one type of oxygen sensor. The output voltage of the λ sensor varies in a digital manner as the air-fuel ratio of the mixture supplied to the internal combustion engine changes between values lower and higher than the predetermined stoichiometric air-fuel ratio.

The input of an integrating circuit in the electronic control fuel supply system is connected to the output of the λ sensor, and the output of the integrating circuit is connected to a fuel injection valve which injects fuel into the intake system of the engine. In this connection, the air-fuel ratio control is subjected to a hunting phenomenon because a time lag occurs between the variation of the air-fuel ratio of the introduced mixture and the variation in output voltage of the λ sensor; i.e., there is a dead time for the response of this control system.

If the level of hunting is to be minimized, the time constant of the integrating circuit must be set to an optimum value. However, it is difficult to achieve compatibility between the follow-up characteristics of the actual air-fuel ratio and the stoichiometric air-fuel ratio during the transient phase of the engine.

SUMMARY OF THE INVENTION

It is a principal object of the present invention to provide an electronic control fuel supply system for use in an internal combustion engine which minimizes the level of hunting and provides excellent follow-up characteristics during the transient phase.

According to the present invention, there is provided an electronic control fuel supply system for use in an internal combustion engine in which a λ sensor provided in the exhaust system of the engine is connected by means of a Schmidt circuit, an integrating circuit and a fuel-amount control circuit to a fuel injection valve which opens into the intake system of the engine. An acceleration switch positioned in the intake system of the engine is connected by means of a first differentiating circuit, one input of an adding circuit, a flip-flop, one input of an AND gate and a second drive circuit to a control terminal of the integrating circuit. In addition, the Schmidt circuit is connected to a second differentiating circuit which is connected by way of a first switch to a second input of the adding circuit. The output of the Schmidt circuit is further connected to a NOT circuit, which is connected to a second input of the AND gate. The flip-flop is also connected to a first drive circuit which controls the first switch interposed between the second differentiating circuit and the adding circuit.

DESCRIPTION OF THE PREFERRED EMBODIMENT

Figure 1:
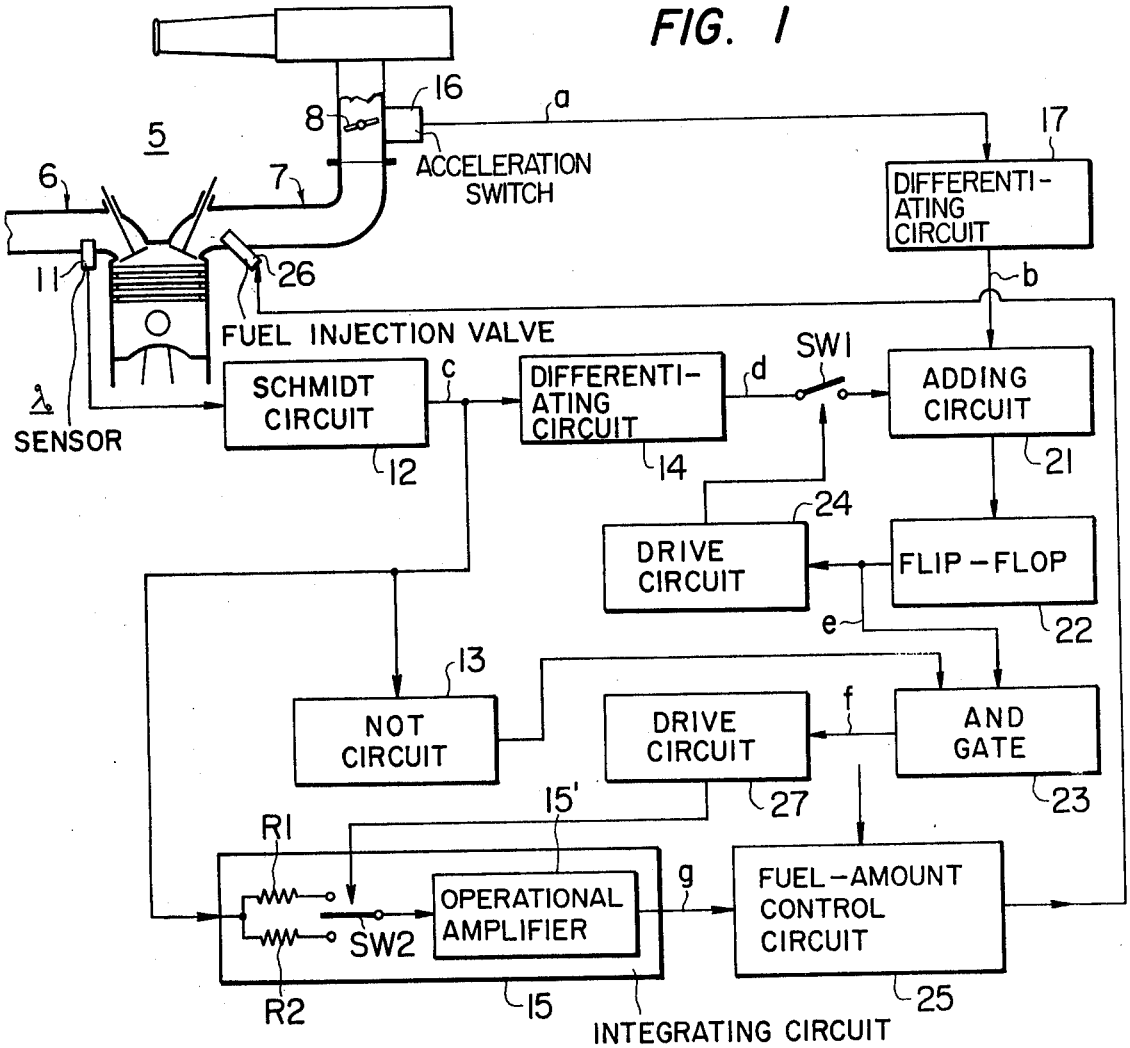
FIG. 1 is a block diagram illustrative of one embodiment of the present invention.

One embodiment of the present invention will now be described in detail with reference to FIG. 1.

Hereinafter, a digital signal of a high voltage level will be designated '1', and a signal of a low voltage level will be designated '0'. A λ sensor 11 provided in the exhaust system of an internal combustion engine 5 generates a digital signal '1' when the air-fuel ratio of the mixture being supplied to the internal combustion engine 5 is smaller than the stoichiometric air-fuel ratio; that is, when the mixture is rich. The λ sensor 11 generates a digital signal '0', when the air-fuel ratio of the mixture is larger than the stoichiometric air-fuel ratio; that is, when the mixture is lean. The output of the λ sensor 11 is connected to the input of a Schmidt circuit 12. The output of the Schmidt circuit 12 is connected to the respective inputs of a NOT circuit 13, a differentiating circuit 14 and an integrating circuit 15.

An acceleration switch 16 is provided in the intake system 7 of engine 5 and generates a digital signal '1' when the level of the intake vacuum is being lowered. In other words, when a throttle valve 8 in the carburetor of the engine has been maintained at a given opening and a force is then applied to the accelerator pedal, the opening of the throttle valve 8 is increased so that the level of the intake vacuum is lowered. The acceleration switch 16 detects this accelerated condition of the engine.

The output of the acceleration switch 16 is connected by differentiating circuit 17 to one input of an adding circuit 21. The output of the differentiating circuit 14 is connected by a switch SW1 to a second input of the adding circuit 21 and the output of the adding circuit 21 is connected to the input of a flip-flop 22. The output of the flip-flop 22 is connected to one input of an AND gate and to the input of a first drive circuit 24.

During the time that a digital signal '1' is being fed to the first drive circuit 24, the first drive circuit 24 keeps the switch SW1 closed. On the other hand, during the time that a digital signal '0' is being fed thereto, the first drive circuit keeps the switch SW1 open. The output of the NOT circuit 13 is connected to a second input of the AND gate 23 and the output of the AND gate 23 is connected to the input of a second drive circuit 27.

The second drive circuit 27 controls the switch SW2 in the integrating circuit 15. During the time that a digital signal '1' is being fed to the second drive circuit 27, the switch SW2 is maintained connected to a resistor $R_1$. On the other hand, during the time that a digital signal '0' is being fed to the second drive circuit 27, the switch SW2 is maintained connected to a resistor $R_2$ having a resistance higher than that of the resistor $R_1$. The integrating circuit 15 also includes an operational amplifier 15' coupled to switch SW2 and to the input of a fuel-amount control circuit 25.

The integrating circuit 15 provides an output voltage having a phase which is the reverse of the phase of the voltage applied to its input. The fuel-amount control circuit 25 compensates for the input voltage thereto according to signals associated with the temperature of the engine, the actual air-fuel ratio of the mixture supplied to the engine, as well as other engine parameters, and generates a signal corresponding to the optimum open duration of the fuel injection valve 26. A typical fuel-amount control circuit suitable for use with the present system is described in the U.S. Pat. No. 3,815,561.

Figure 2:
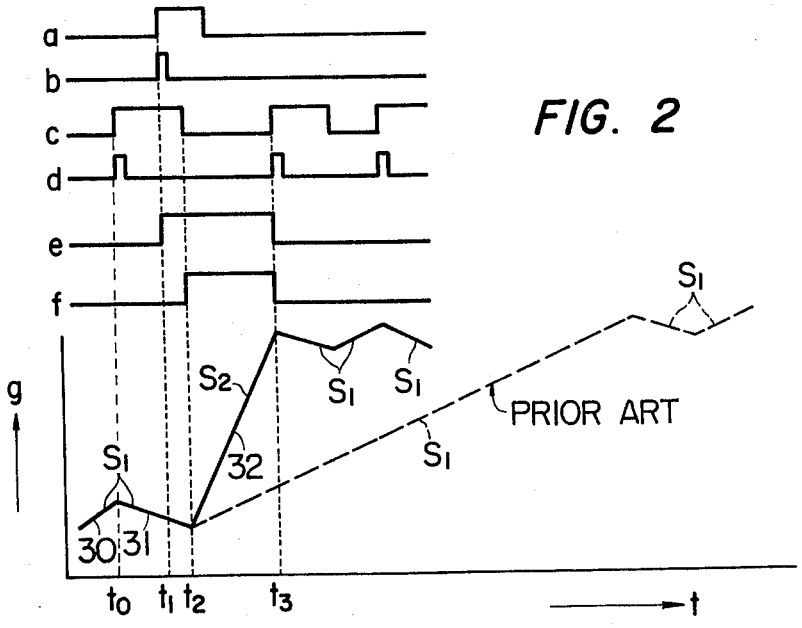
FIG. 2 shows waveform diagrams illustrating the relationship between respective output pulses and time.

FIG. 2 is a timing diagram showing the voltage waveforms existing at similarly designated points of the system of FIG. 1. In FIGS. 1 and 2, *a* represents the output of the acceleration switch 16, *b* the output of the first differentiating circuit 17, *c* the output of the Schmidt circuit 12, *d* the output of the second differentiating circuit 14, *e* the output of flip-flop 22, *f* the output of AND gate 23 and *g* the output of the integrating circuit 15.

Prior to the time $t_1$, the internal combustion engine is in a normal running mode and is not being accelerated. Under this condition, the acceleration switch 16 is in its open position and the output *a* is zero. According, the output *e* of the flip-flop 22 is also zero, switch SW1 is open and switch SW2 is connected to resistor $R_2$ having a high resistance relative to the resistance of resistor $R_1$. In other words, the time constant of the integrating circuit 15 is relatively high and the output *g* of the integrating circuit 15 increases at 30 and decreases at 31 with a slight gradient $S_1$ in accordance with the output of the Schmidt circuit 12.

Assuming that acceleration of the internal combustion engine is started at the time $t_1$, the opening of the throttle valve 8 in the carburetor is increased. Consequently, the vacuum level in the intake system 7 of the internal combustion engine is lowered, the acceleration switch 16 is closed and the output *a* of switch 16 changed from '0' to '1'. The output *a* is differentiated by the differentiating circuit 17, and the output *b* of the differentiating circuit 17 fed by way of adding circuit 21 to the flip-flop 22 which reverses its output *e* from '0' to '1'. Consequently, a digital signal '1' is fed to the drive circuit 24 and circuit 24 closes the switch SW1.

In the time interval $t_0$ to $t_2$, the output of the sensor 11 is '1' corresponding to a rich mixture so that the output of the NOT circuit 13 is '0'. The output *f* of the AND gate 23 causes the switch SW2 to be connected to resistor $R_2$. Thus, during the interval between the time $t_1$ and the time $t_2$, the output *g* of the integrating circuit 15 maintains the slight negative gradient $S_1$.

An increase in the opening of the throttle valve 8 leads to an increase in the air-fuel ratio of the mixture being supplied to the engine. However, there necessarily takes place a time lag until the mixture is burned and then reaches the exhaust system, so that the output of the λ sensor remains at '1' (indicating a rich mixture) up to the time $t_2$. At time $t_2$, the effect of the increase in the air-fuel mixture is sensed by the λ sensor 11 at the exhaust system and the output *c* of the Schmidt circuit 12 switched from '1' to '0'. As a result, the output of the NOT circuit 13 switches from '0' to '1', the drive circuit 27 is energized and switch SW2 changes the resistance of the integrating circuit from the high value $R_2$ to the lower value $R_1$. This causes the output voltage *g* of the integrating circuit 15 to switch from a linearly decreasing waveform 31 having a slight gradient $S_1$ to a lineraly increasing voltage 32 having a relatively steep gradient $S_2$.

Under the operating conditions depicted in FIG. 2, the air-fuel ratio being sensed by the λ sensor 11 shortly after acceleration is rich and the output *g* of the integrating circuit 15 is decreasing as shown at 31. If the air-fuel ratio at the beginning of the acceleration is lean, the output *g* of the integrating circuit will be increasing and the rate of increase will change from $S_1$ to $S_2$ at time $t_1$ rather than $t_2$ because the input to AND gate 23 from NOT circuit 13 will be "1". That is, as soon as the output *e* of flip-flop 22 changes to "1" as a consequence of the closing of acceleration switch 16, switch SW2 will be switched from the large resistor $R_2$ to the smaller resistor $R_1$ and this will occur at time $t_1$.

As the voltage of the output *g* of the integrating circuit 15 increases, the time interval during which the fuel injection valve 26 is open will be increased. Consequently, the air-fuel ratio of the mixture being supplied to the engine will be decreased and the mixture will become rich as compared to the stoichiometric air fuel-ratio. Thus, at time $t_3$, the output of the λ sensor 11 will become '1'. Accordingly, a digital signal '1' is fed to the flip-flop 22 by way of the Schmidt circuit 12, differentiating circuit 14 and adding circuit 21. In this manner, the output *e* of the flip-flop 22 is changed to the initial level '0' and the switch SW1 opened by the first drive circuit 24. In addition, the output *f* of the AND circuit 23 is switched to '0' and the switch SW2 connected to resistor $R_2$ having a high resistance by means of the second drive circuit 27. As a result, the output *g* of the integrating circuit 15 again fluctuates with a slight gradient $S_1$ from the time $t_3$ until the time at which the next acceleration is begun.

The broken line labeled Prior Art in FIG. 2 represents changes in the output *g* of the integrating circuit 15 in a known electronic control fuel supply system. As can be seen from FIG. 2, the output *g* of the prior art integrating circuit 15 maintains a slight gradient $S_1$ even at the time of acceleration, presenting a poor follow-up characteristic by the actual air-fuel ratio with respect to the stoichiometric air-fuel ratio.

Figure 3:
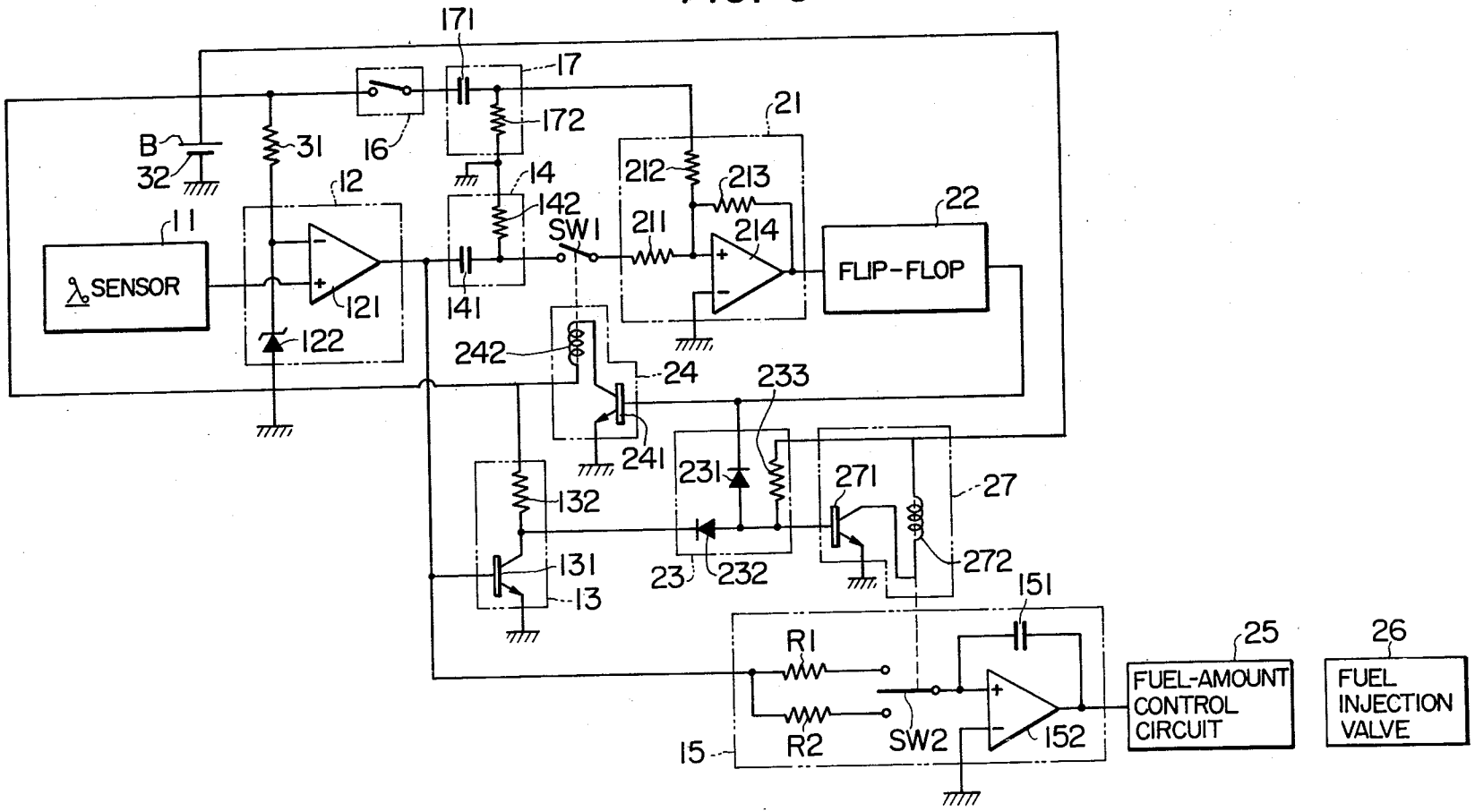
FIG. 3 is a detailed circuit diagram of the embodiment of FIG. 1.

FIG. 3 is a detailed circuit diagram of the embodiment of FIG. 1.

The Schmidt circuit 12 consists of an amplifier 121 and a zener diode 122. The positive input terminal of the amplifier 121 is connected to the output of the λ sensor 11 and the negative input terminal of the amplifier is grounded by the zener diode 122 and connected by a resistor 31 to the positive side of a D.C. power source 32, the negative side of the power source being grounded. The second differentiating circuit 14 consists of a capacitor 141 and a resistor 142. One end of differentiating circuit 14 is connected to the output of amplifier 121 and the other end thereof through switch SW1 to an input of adding circuit 21.

One end of the acceleration switch 16 is connected to the positive side of the electric power source 32 and the other end to the input of the first differentiating circuit 17. Differentiating circuit 17 consists of a capacitor 171 and a resistor 172, the output thereof being connected to an input of the adding circuit 21. The adding circuit 21 consists of resistors 211, 212, 213 and an amplifier 214. The input of the flip-flop 22 is connected to the output of the amplifier 214 and the output thereof is connected to an input of the AND gate 23 and to the input of the first drive circuit 24.

The first drive circuit 24 consists of a transistor 241 and a coil 242. One end of the coil 242 is connected to the positive side of the electric power source 32 and the other end thereof is connected to the collector of transistor 241, thereby controlling the opening and closing operation of switch SW1.

The input of the NOT circuit 13 is connected to the output of the amplfier 121. The NOT circuit 13 consists of a transistor 131 and a resistor 132. The collector of transistor 131 is connected by the resistor 132 to the positive side of the electric power source 32 and to the second input of the AND gate 23. The AND gate 23 consists of diodes 231, 232 and a resistor 233, the output of the AND gate 23 being connected to the input of the second drive circuit 27.

In the second drive circuit 27, the collector of a transistor 271 is connected by way of a coil 272 to the positive terminal of the electric power source 32. When excited, the coil 272 causes the switch SW2 to be connected to the resistor $R_1$. When deenergized, switch SW2 is connected to resistor $R_2$.

The integrating circuit 15 consists of resistors $R_1$, $R_2$, switch SW2, capacitor 151 and amplifier 152. Integrating circuit 15 is also referred to as a mirror integrating circuit because it reverses the phase of its output voltage relative to that of the applied input voltage. The input of the integrating circuit 15 is connected to the output of amplifier 121 and the output thereof is connected to the input of the fuel-amount control circuit 25. The output of the fuel-amount control circuit 25 is connected to the fuel injection valve 26.

As is apparent from the foregoing description of the electronic control fuel supply system according to the present invention, the level of hunting may be reduced to less than a given value.

While the present invention has been described herein with reference to one embodiment thereof, it should be understood that various changes, modifications and alterations may be effected without departing from the spirit and scope of the present invention, as defined in the appended claims.

What is claimed is:

1. An electronic fuel supply system for use in an internal combustion engine having intake and exhaust systems comprising:

air-fuel ratio sensing means located in the exhaust system of said internal combustion engine for providing an output signal corresponding to the ratio of air to fuel being supplied to said engine;

an integrating circuit having first and second time constant values coupled to the output of said air-fuel ratio sensing means, said first time value being greater than said second time constant value;

acceleration switch means located in the intake system of said engine for detecting variations in the vacuum level of the intake air, said switch means having a first position when said engine is not being accelerated and a second position after the start of acceleration;

control means coupling said air-fuel ratio sensing means and said acceleration switch means to said integrating circuit, said control means switching the time constant of said integrating circuit from said first value to said second value when said acceleration switch means is in said second position and when the output signal from said air-fuel ratio sensing means indicates that the air-fuel ratio of the mixture being supplied to said engine is greater than a predetermined ratio; and fuel injection means located in the intake system of said engine coupled to the output of said integrating circuit, said fuel injection means injecting fuel into the intake system of said engine for a duration determined by the output of said integrating circuit.

2. An electronic fuel supply system as defined by claim 1 wherein said control means comprises an AND gate having a first input coupled to said acceleration switch, a second input coupled to said air-fuel ratio sensing means and an output coupled to said integrating circuit.

3. An electronic fuel supply system as defined by claim 2 wherein said acceleration switch means is coupled to the first input of said AND gate by a first differentiating circuit coupled to said acceleration switch, an adding circuit having a first input coupled to the output of said first differentiating circuit, and a flip-flop having its input coupled to the output of said adding circuit and its output coupled to the first input of said AND gate.

4. An electronic fuel supply system as defined by claim 3 wherein the input terminal of said integrating circuit is coupled to the output of said air-fuel ratio sensing means by a Schmidt circuit, a second differentiating circuit is coupled to the output of said Schmidt circuit and a first switch is interposed between the output of said second differentiating circuit and a second input of said adding circuit, a first drive circuit being coupled between the output of said flip-flop and said first switch for controlling the position of said first switch.

5. An electronic fuel supply system as defined by claim 2 wherein the input terminal of said integrating circuit is coupled to the output of said air-fuel ratio sensing means by a Schmidt circuit.

6. An electronic fuel supply system as defined by claim 4 wherein a NOT circuit couples the output of said Schmidt circuit to the second input of said AND gate, a second drive circuit being coupled between the output of said AND gate and said integrating circuit.

7. An electronic fuel supply system as defined by claim 6 wherein said integrating circuit comprises first and second resistors each having one end coupled to the output of said Schmidt circuit, and a second switch selectively coupling one of said resistors to the output of said integrating circuit, the selection of said first or second resistor being controlled by said second drive circuit.

8. An electronic fuel supply system as defined by claim 7 which further comprises a fuel-amount control circuit coupling the output of said integrating circuit to the input of said fuel injection means.

* * * * *